US006681448B2

(12) United States Patent
Liang

(10) Patent No.: US 6,681,448 B2
(45) Date of Patent: Jan. 27, 2004

(54) HINGE ASSEMBLY FOR A VEHICLE DOOR

(75) Inventor: Chuan Liang, Scaborough (CA)

(73) Assignee: Ventra Group Inc., Bradford (CA)

( * ) Notice: Subject to any disclaimer, the term of this patent is extended or adjusted under 35 U.S.C. 154(b) by 140 days.

(21) Appl. No.: 10/079,886

(22) Filed: Feb. 22, 2002

(65) Prior Publication Data

US 2002/0194705 A1 Dec. 26, 2002

Related U.S. Application Data

(60) Provisional application No. 60/299,718, filed on Jun. 22, 2001.

(51) Int. Cl.[7] ..... E05D 11/10

(52) U.S. Cl. ..... 16/336; 16/335; 16/334; 296/146.12; 49/258; 49/246; 49/259

(58) Field of Search ..... 16/336, 323, 324, 16/341, 350, 335, 334, 233; 296/146.1, 146.12; 49/257, 254, 258, 259, 246, 248, 249

(56) References Cited

U.S. PATENT DOCUMENTS

| | | | | | |
|---|---|---|---|---|---|
| 521,772 | A | | 6/1894 | Vaughan, Jr. | |
| 1,735,696 | A | | 11/1929 | Ridley | |
| 1,961,205 | A | | 6/1934 | De Vizcaya | |
| 2,870,477 | A | | 1/1959 | Anthony et al. | |
| 3,016,261 | A | * | 1/1962 | Tatter | 49/246 |
| 3,085,297 | A | | 4/1963 | Linderfelt | |
| 3,095,600 | A | * | 7/1963 | Bretzner | 16/224 |
| 3,150,408 | A | | 9/1964 | Belsky | |
| 3,470,579 | A | | 10/1969 | Cencioni | |
| 3,619,853 | A | | 11/1971 | Merrill | |
| 3,651,539 | A | | 3/1972 | Breunich et al. | |
| 3,758,990 | A | * | 9/1973 | Balanos | 49/153 |
| 4,470,170 | A | | 9/1984 | Gerteis | |
| 4,495,674 | A | | 1/1985 | Haddock, Jr. | |
| 4,719,665 | A | | 1/1988 | Bell | |
| 4,744,127 | A | | 5/1988 | Shadley | |
| 4,833,755 | A | * | 5/1989 | Bonin | 16/344 |
| 4,854,010 | A | * | 8/1989 | Maraghe et al. | 16/360 |
| 4,928,350 | A | | 5/1990 | Morgan | |
| 4,930,836 | A | | 6/1990 | Grinn | |
| 5,346,272 | A | | 9/1994 | Priest et al. | |
| 5,398,988 | A | * | 3/1995 | DeRees et al. | 296/155 |
| 5,491,875 | A | * | 2/1996 | Siladke et al. | 16/346 |
| 5,561,887 | A | | 10/1996 | Neag et al. | |
| 5,611,114 | A | | 3/1997 | Wood, Jr. et al. | |
| 5,632,065 | A | | 5/1997 | Siladke et al. | |
| 5,685,046 | A | | 11/1997 | Neag et al. | |
| 5,876,086 | A | | 3/1999 | Lagrou et al. | |
| 5,901,415 | A | | 5/1999 | Morrison et al. | |
| 5,915,441 | A | | 6/1999 | Schlack | |
| 5,943,739 | A | | 8/1999 | Vandergriff | |
| 6,030,025 | A | * | 2/2000 | Kanerva | 296/146.12 |
| 6,038,738 | A | | 3/2000 | Neag et al. | |
| 6,382,705 | B1 | * | 5/2002 | Lang et al. | 296/146.12 |
| 6,386,621 | B1 | * | 5/2002 | Kozak et al. | 296/155 |
| 6,609,748 | B1 | * | 8/2003 | Azzouz et al. | 296/146.1 |

* cited by examiner

*Primary Examiner*—Gary Estremsky
*Assistant Examiner*—Mark Williams
(74) *Attorney, Agent, or Firm*—Pillsbury Winthrop LLP

(57) ABSTRACT

A vehicle door hinge assembly that includes a body bracket, a door bracket, and, an interconnecting door bracket carrier. The door bracket carrier and the door bracket shift in unison from a fully closed position to an intermediate open position. The door bracket pivots in a swinging motion about the door bracket carrier from the intermediate open position to a fully open position. The hinge assembly further includes a motion restriction mechanism that restricts the door bracket from pivoting relative to the door bracket carrier when the door bracket carrier is not in the intermediate open position. Additionally, the motion restriction mechanism restricts the linkage assembly from moving relative to the body bracket until the door bracket has returned to the intermediate open position. A door attached to the hinge assembly moves first in a shifting motion and then in a swinging motion. The shifting motion moves the door laterally and outwardly relative to a vehicle body.

18 Claims, 11 Drawing Sheets

HINGE ASSEMBLY FOR A VEHICLE DOOR

The present application claims priority to U.S. Provisional Application of Chuan Liang, Application Serial No. 60/299,718, filed Jun. 22, 2001 the entirety of which is incorporated into the present application by reference.

FIELD OF THE INVENTION

The present invention relates to a door hinge assembly for installation in a vehicle for attaching a vehicle door to a vehicle body.

BACKGROUND OF THE INVENTION

Certain types of vehicles have adjacent doors that open in opposite handed manners with respect to one another. These adjacent doors typically latch to one another, or to an intermediate pillar of the vehicle body, for securement in their closed positions. In known designs, each of these doors swing about a pivot defined by a hinge assembly. However, in these known designs, the swing arcs of the doors overlap because of the thickness of the doors. The overlap of the swing arcs occurs because each of the doors are panel constructions having a substantial thickness. As a result, one of the doors must be opened prior to the other door. Similarly, when closing the doors, one door must be closed prior to the other door.

An example of a vehicle with a door configuration of this type is a pickup truck with an extended cab having adjacent front and rear doors on at least one side of the vehicle. In this configuration, the front door must be opened before (and closed after) the rear door. This is because the front doors are typically used more frequently that the rear doors. A similar door configuration is often used in vehicles such as vans or sport utility vehicles that have side by side cargo doors at the rear of the vehicle. Here again, a first door must typically be opened before the other door can be opened.

This door configuration is undesirable for several reasons. Passengers that are seated in the rear seat of a pickup truck are not able to open the rear doors of the cab, unless the adjacent front door has been opened first. This is inconvenient and may require the person sitting in the rear seat to somehow reach the door handle of the front door. Only after having first opened the front door can the person sitting in the rear seat open the rear door. Putting cargo behind the front seat of the pickup also requires the user to first open the front door, then open the rear door, and finally place the cargo in the desired location. Obviously in certain circumstances, this extra effort is inconvenient, especially while handling large or awkward articles. Likewise, if a vehicle user needs to place an infant in a child seat behind the front seat of the vehicle, the vehicle user must perform the extra steps required to open the rear door while holding the infant.

SUMMARY OF THE INVENTION

The present invention solves the problems addressed above by providing an improved hinge assembly for attaching a vehicle door to a vehicle body in covering relation to a door opening in the vehicle body. The hinge assembly comprises a body bracket configured to be mounted to the vehicle body, a door bracket configured to be attached to the vehicle door, and, a door bracket carrier having the door bracket pivotally mounted thereon. The door bracket carrier is movably mounted to the body bracket such that, when the door bracket is attached to the vehicle door and the body bracket is attached to the vehicle body, the door bracket and the vehicle door to which the door bracket is attached move relative to the vehicle body and the body bracket between a fully closed position and a fully opened position through a multiple phase movement. The multiple phase movement comprises a shifting phase and a swinging phase. In the shifting phase, the door bracket carrier, the door bracket, and the door to which the door bracket is attached move in a shifting manner from the fully closed position to an intermediate open position. In the swinging phase, the door bracket and the door to which the door bracket is attached move in a swinging manner relative to vehicle body between the intermediate position and the fully open position.

The hinge assembly includes motion restriction structure that restricts movement of the door bracket relative to the body bracket such that the door bracket is fixed with respect to the door bracket carrier during the shifting phase. During the shifting phase, movement of the door bracket and the door to which the door bracket is attached is restricted to the shifting manner. Additionally, the motion restriction structure restricts movement of the door bracket carrier with respect to said body bracket during the swinging phase. During the swinging phase, movement of the door bracket and the door to which the door bracket is attached is restricted to the swinging manner, thereby preventing movement of the door in the shifting manner from occurring prior to or during movement of the door in the swinging manner.

Objects, features and advantages of the present invention will become apparent from the following detailed description, the accompanying drawings, and the appended claims.

BREIF DESCRIPTION OF THE DRAWINGS

Figure 11:
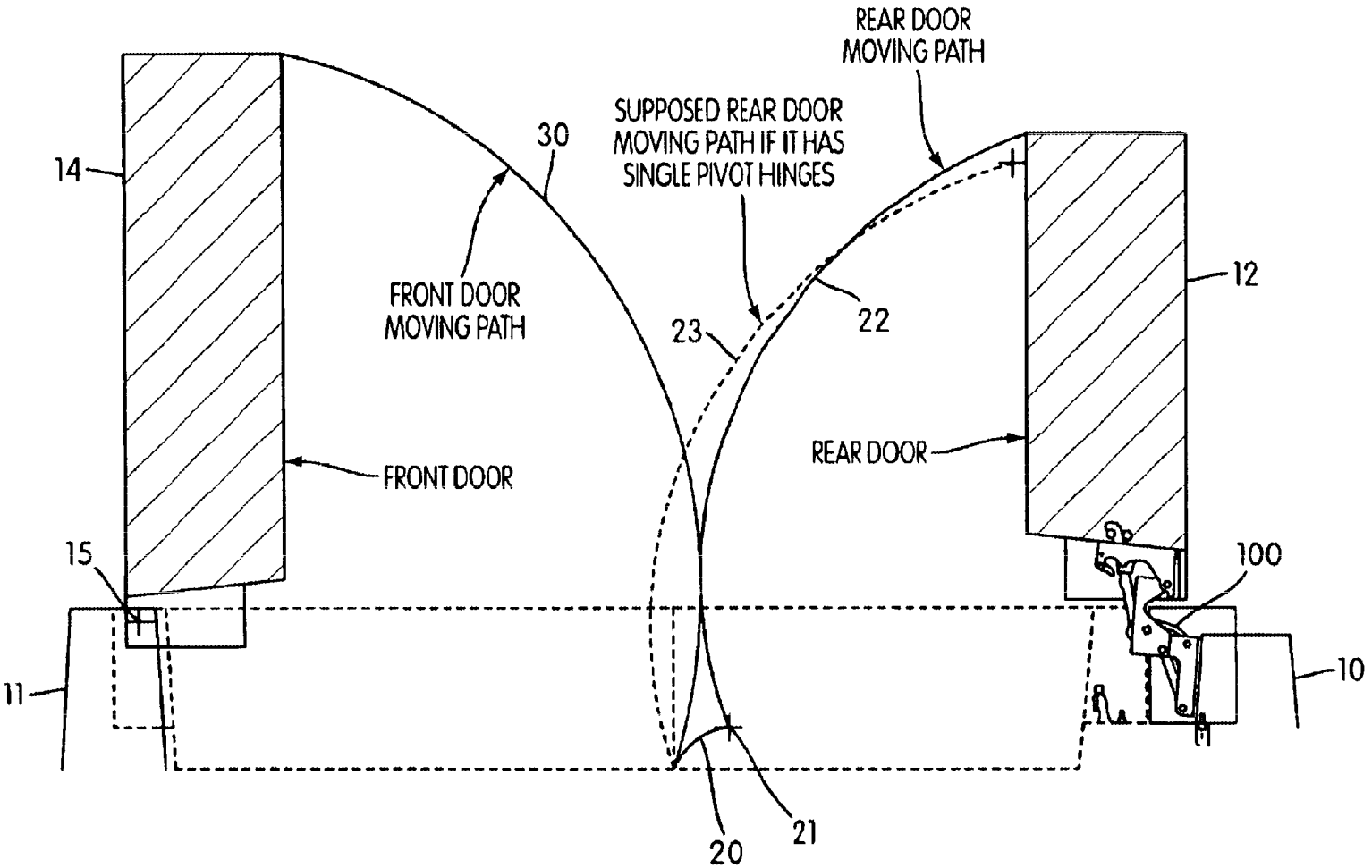

FIG. 11 is a top view showing the hinge assembly of the invention attached to a first vehicle door. The modes of movement of the first vehicle door are shown from the fully closed position to the intermediate open position, and from the intermediate open position to the fully open position. An adjacent vehicle door is also shown. The movement of the first door relative to the movement of the adjacent door is also shown.

DETAILED DESCRIPTION OF A PREFERRED EMBODIMENT OF THE INVENTION

Figure 1:
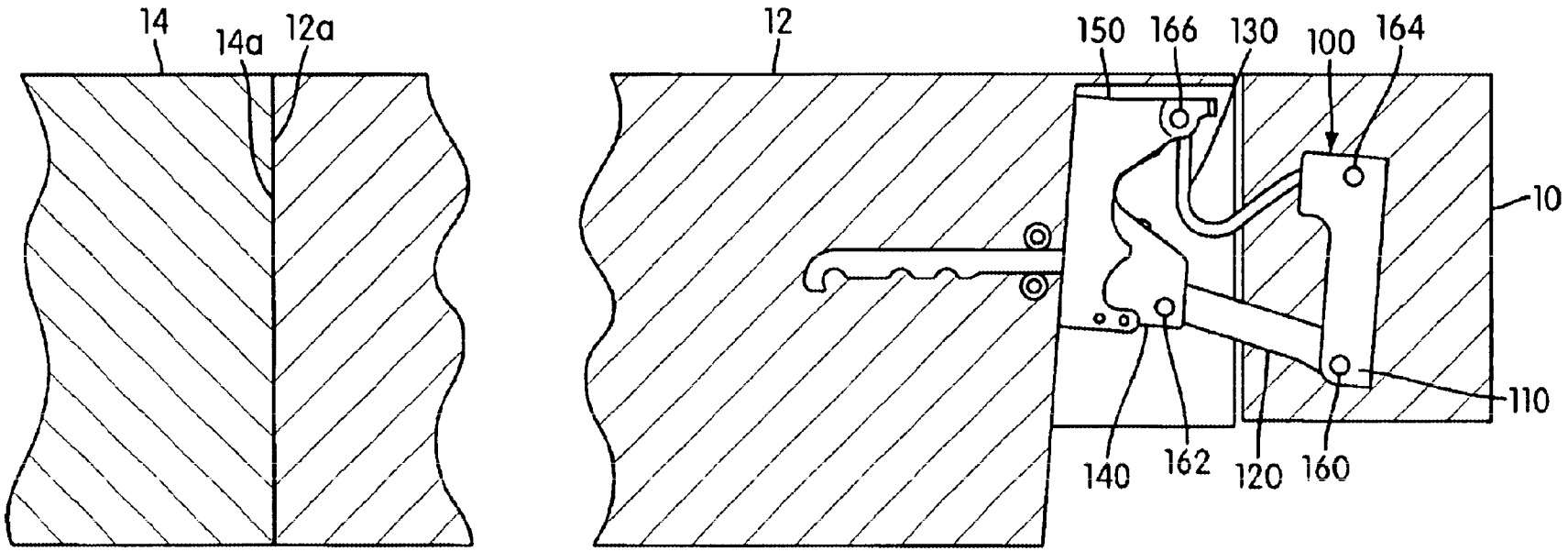
FIG. 1 is a top view showing the hinge assembly of the invention attached to a vehicle body and a vehicle door. The hinge assembly and the vehicle door are shown in the fully closed position.

FIG. 1 shows a hinge assembly 100 which includes: a body bracket 110; a first link arm 120 pivotally attached to the body bracket 110; a second link arm 130 also pivotally attached to the body bracket 110; a door bracket carrier 140 pivotally attached to the first link arm 120 and the second link arm 130; and, a door bracket 150 pivotally attached to the door bracket carrier 140.

As will be shown in the following figures, the door bracket carrier 140 moves relative to the body bracket 110 along a path of movement defined by the geometry of a four bar linkage defined by the body bracket 110, the first and second link arms 120 and 130, and the door bracket carrier 140. Four pivot pins 160, 162, 164, and 166 facilitate the relative movement of the door bracket carrier 140 with respect to the body bracket 110. The path of the door bracket carrier 140 is generally parallel to the door bracket 150. The door bracket 150 pivots about the door bracket carrier 140 at pivot pin 166. The door bracket carrier 140 and the link arms 120 and 130 comprise a linkage assembly that interconnects the door bracket 150 to the body bracket 110. Although in the illustrated embodiment, the linkage assembly is designed as a four bar linkage, the linkage assembly may have any other suitable design.

FIG. 1 also shows the hinge assembly 100 disposed in a typical application where the body bracket 110 is attached to a vehicle body 10, and the door bracket 150 is attached to a door 12. The portion of the vehicle body 10 to which the body bracket 110 is attached is typically the B-pillar. An adjacent vehicle door 14 is also shown. The adjacent vehicle door 14 is hingedly connected to the A-pillar of the vehicle body, but the illustrated structure 14 could also be a fixed part of the vehicle body, such as a B-pillar, or other body component. The body 10, door 12, and adjacent vehicle door 14 are all shown in cross section. FIG. 1 shows the hinge assembly 100 and, accordingly, the door 12 in the fully closed position. The vehicle doors may latch to the B-pillars, or alternatively, the doors may latch to one another. Latches are not shown in this figure.

Figure 2:
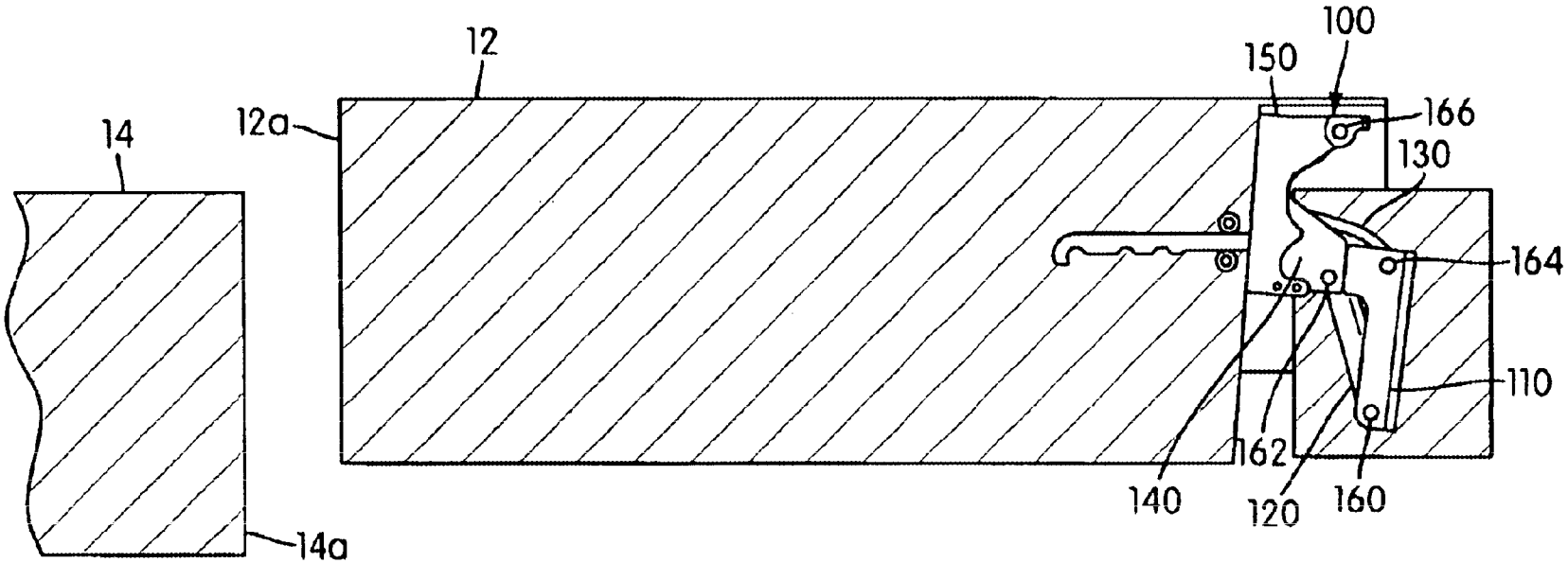
FIG. 2 is a top view showing the hinge assembly of the invention attached to a vehicle body and a vehicle door. The hinge assembly and the vehicle door are shown in the intermediate open position.

FIG. 2 shows the hinge assembly 100 and the door 12 supported thereby after the door 12 has been moved to an intermediate open position. FIG. 2 shows the position of the door bracket carrier 140 after the door 12 has moved to its intermediate open position. The door bracket carrier 140 has moved relative to the body bracket 110 through the pivoting movement of the first and second link arms 120 and 130 which pivot substantially in the same plane. During this movement, the door bracket 150 has been locked to the door bracket carrier 140. Accordingly, the door bracket 150 in the intermediate open position has not moved relative to the door bracket carrier 140 but has moved in unison with the door bracket carrier 140. The manner in which this locking is accomplished will be described herein below.

This movement of the hinge assembly 110 as the door 12 moves to the intermediate open position results in a gap that separates the door 12 from the adjacent vehicle door 14. Specifically, the gap separates the lateral edge 12*a* of the door 12 from the lateral edge 14*a* of the vehicle door 14. As can be appreciated from comparing FIGS. 1 and 2, the mode of movement of the hinge assembly 110 from the fully closed condition to the intermediate open position is a shifting type of motion. During the shifting motion, the door moves both outwardly in relation to the door opening and away from the adjacent door 14. In the specific embodiment shown in FIGS. 1 and 2, this shifting movement is a curvilinear movement. Any other type of movement, however, may be envisioned.

Figure 3:
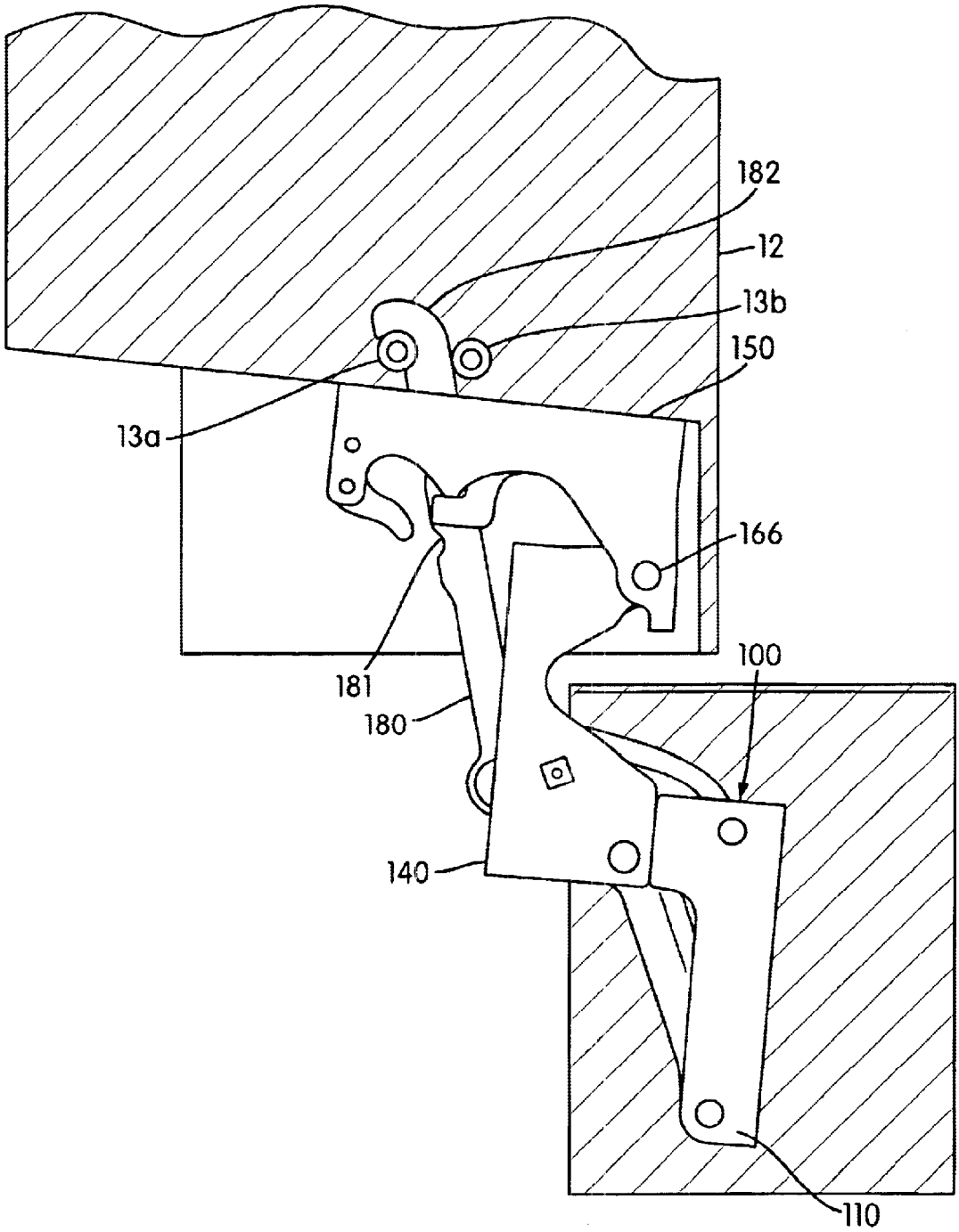
FIG. 3 is a top view showing the hinge assembly of the invention attached to a vehicle body and a vehicle door. The hinge assembly and the vehicle door are shown in the fully open position.

FIG. 3 shows the door 12 moved to what is typically the fully open position. The door 12 and the door bracket 150 to which the door 12 is attached have pivoted relative to the door bracket carrier 140 from the intermediate open position, which was previously shown in FIGS. 1 and 2, to the fully open position shown in FIG. 3. The door bracket 150 pivots about the pivot pin 166. The door bracket carrier 140 has remained in the same position it was in when the door 12 was in the intermediate open position, as was previously shown in FIG. 2. This results from the door bracket carrier being locked from movement relative to the body bracket 110 while the door bracket 150 moves from the intermediate open position to the fully open position.

Also shown in FIG. 3 is a door check arm 180 which includes a stop detent 182, which is shown engaging a roller 13*a* disposed on the door 12. The door check arm 180 further includes a door check detent 181. The door check arm 180 moves with respect to the door 12 between spring biased rollers 13*a* and 13*b* disposed on the door 12. Alternatively, the rollers 13*a* and 13*b* may be incorporated into the door bracket 150. The door check arm 180 is attached to the door bracket carrier 140. Fixed pins or other structures may be used in place of rollers 13*a*, 13*b*.

Figure 4:
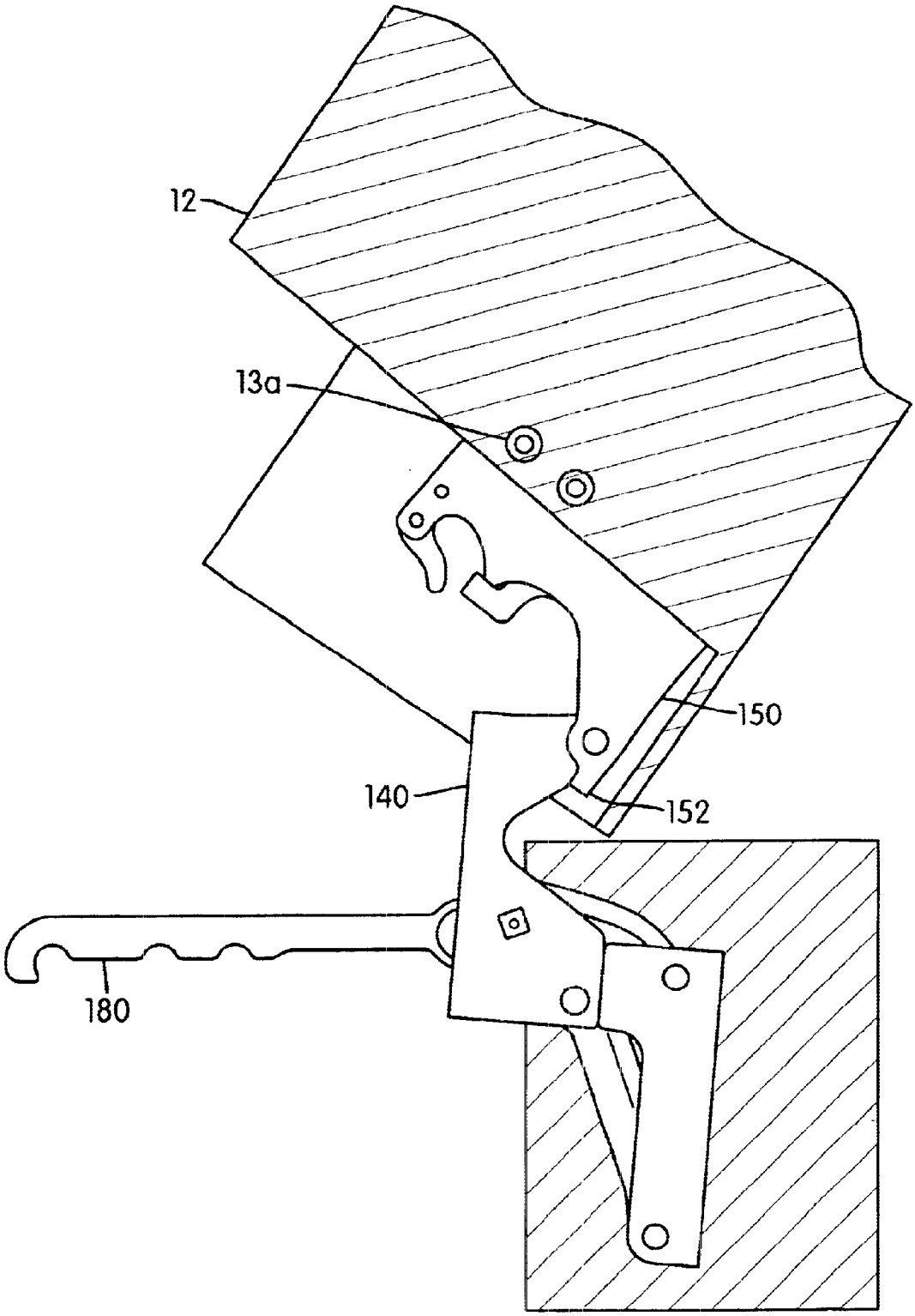
FIG. 4 is a top view showing the hinge assembly of the invention attached to a vehicle body and a vehicle door. The hinge assembly and the vehicle door are shown pivoted past what is typically the fully open position.

FIG. 4 shows the door bracket 150 after the door 12 has pivoted beyond the typical fully open position shown in FIG. 3. The door check arm 180 has been released from the pin 13*a*, which has allowed the door 12 to pivot further. This unlikely situation may arise if breakage occurred on the door check arm 180 or one of the rollers 13*a* and 13*b*. As is also shown in this figure, the door bracket 150 includes a stop tab 152, which is shown abutting a stop surface 142 on the door bracket carrier 140. The stop tab 152 stops the pivoting of the door 12, which ensures that damage to the door 12 or the body of the vehicle will not occur. This also will prevent the door 12 from hitting the vehicle body in the event the installing technician fails to properly attach the check arm 180.

Figure 5:
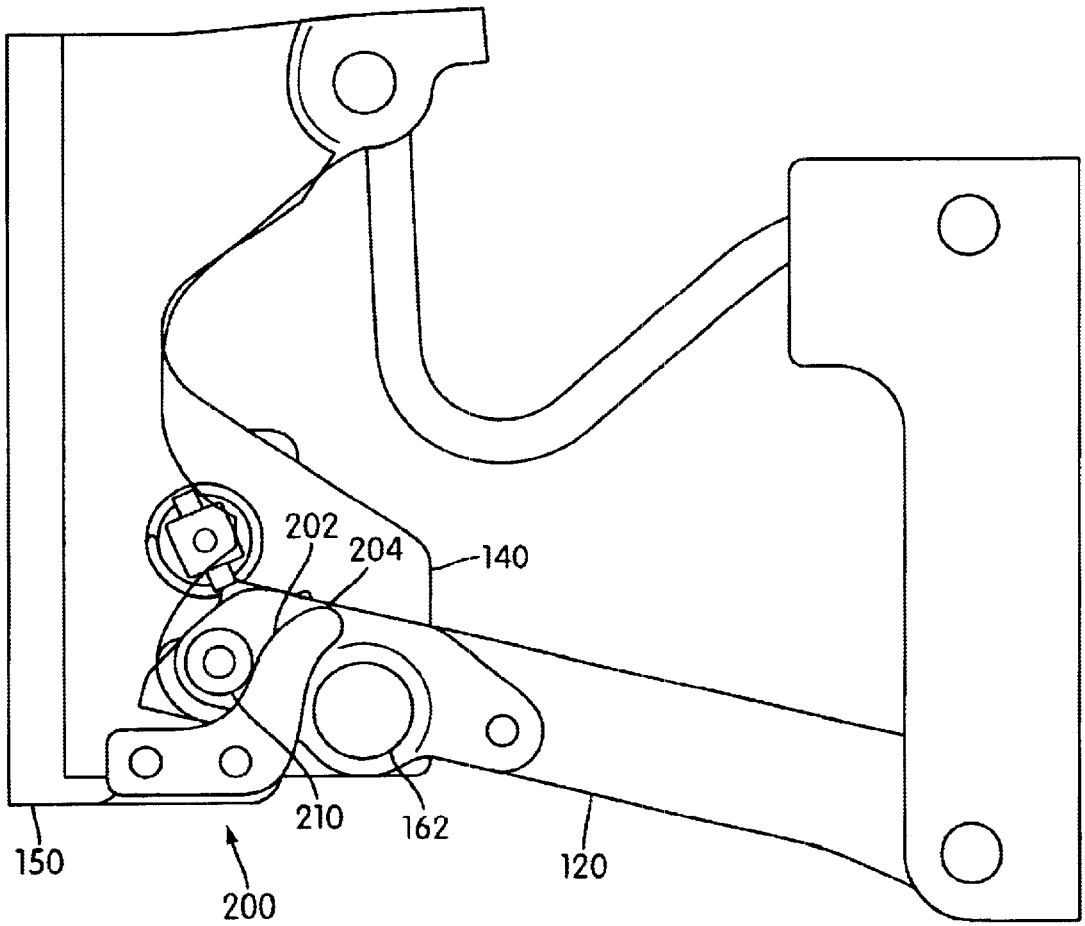
FIG. 5 is a top view of the hinge assembly of the invention showing the hinge assembly in the fully closed position and showing a first lock mechanism in a locked position.
Figure 6:
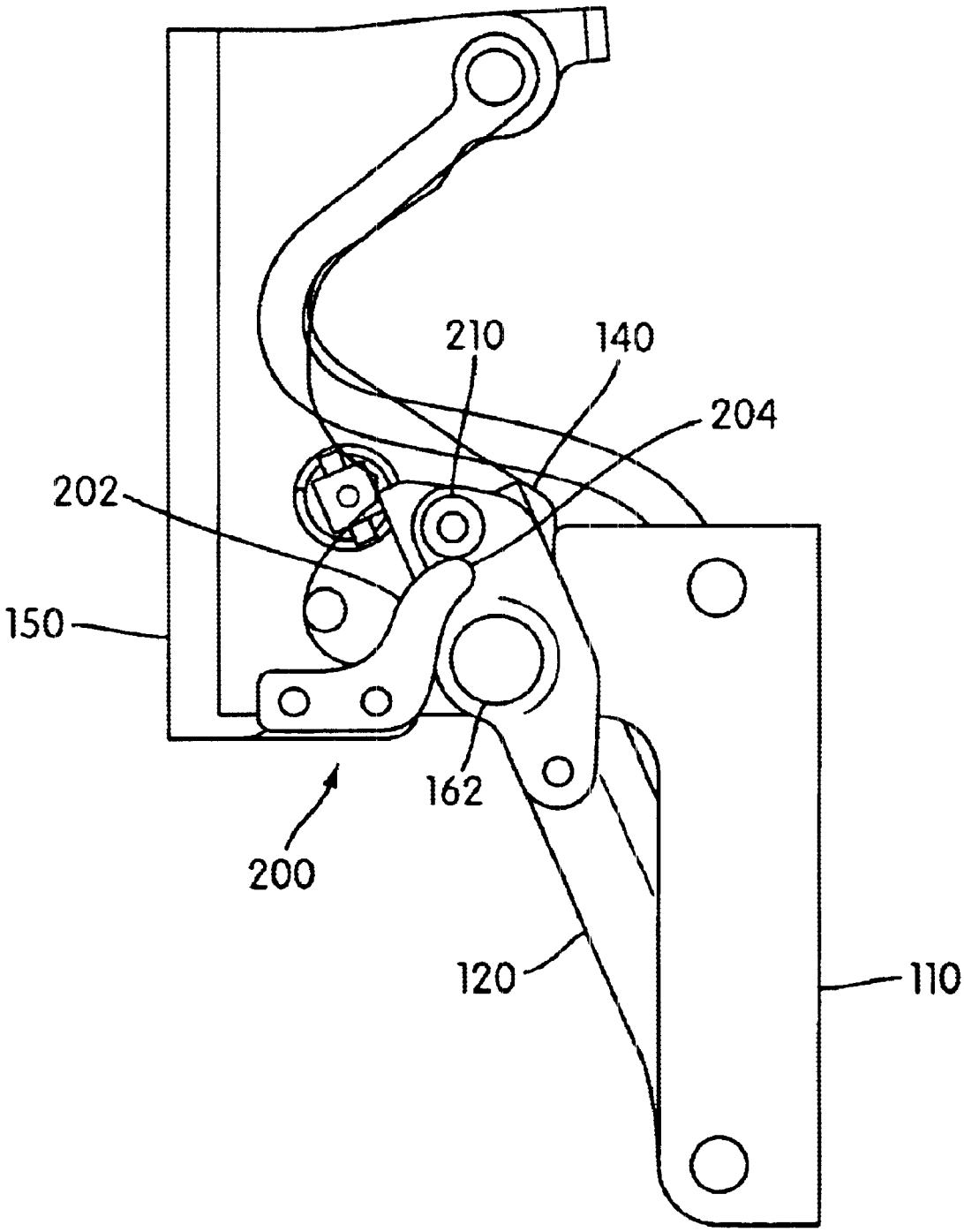
FIG. 6 is a top view of the hinge assembly of the invention showing the hinge assembly in the intermediate open position and showing the first lock mechanism in an unlocked position.

FIGS. 5 and 6 show the operation of a first lock mechanism 200 which locks the door bracket 150 to the door bracket carrier 140. The first lock mechanism 200 and a second lock mechanism comprise a motion restriction mechanism for the hinge assembly. The first lock mechanism 200 secures the door bracket 150 from pivoting relative to the door bracket carrier 140 until the door bracket carrier 140 has moved to the intermediate open position. FIG. 5 shows the hinge assembly 100 in the fully closed position. FIG. 5 further shows the first lock mechanism 200 in the locked position. FIG. 6 shows the hinge assembly 100 in the intermediate open position after the door bracket carrier 140 has moved to the intermediate open position. FIG. 6 further shows the first lock mechanism 200 in the unlocked position.

The first lock mechanism 200 comprises an elongated curved tab 202 that is attached to the door bracket 150 and extends outwardly from the door bracket. The first lock mechanism 200 also includes a roller 210 rotatably connected to the door bracket carrier 140 through the first link arm 120 on pivot pin 162. The elongated curved surface of the tab 202 comprises a first contact surface and the outer cylindrical surface of the roller 210 comprises a second contact surface utilized in the first lock mechanism 200.

FIG. 6 shows how the movement of the door bracket carrier 140 results in the relative movement of the roller 210 in relation to the tab 202. The relative movement of the roller 210 relative to the tab 202 occurs as a result of the roller being directly attached to the first link arm 120, and only indirectly attached to the door bracket carrier 140 through the pivot connection 162. The roller 210 moves relative to the tab 202 from the locked position, when the hinge assembly is at the fully closed position (FIG. 5), to an unlocked position when the hinge assembly is at the intermediate open position (FIG. 6). The outside cylindrical surface of the roller 210 rolls on the elongated curved surface of the tab 202.

FIG. 5 shows the door bracket carrier 140 in the fully closed position and the tab 202 and roller 210 contacting such that the roller 210 restricts movement of the tab 202 in a blocking manner. Accordingly, the door bracket 150 is locked from moving independently of the door bracket carrier 140. The roller 210 contacts the tab 202 and restricts the independent movement of tab in all positions of the door bracket carrier 140 until the door bracket carrier is in the intermediate open position.

FIG. 6 shows the unlocked position of the first lock mechanism 200. The door bracket carrier 140 has pivoted about the body bracket 110 to the intermediate open position. The roller 210 has moved relative to the tab 202 such that the tab distal end 204 can move past the roller 210 (i.e., the first surface is disengaged from the second surface). As the tab 202 is no longer restricted from movement by the roller 210, the tab 202 can move independently relative to the roller 210, and the door bracket 150 can pivot about the door bracket carrier 140.

Figure 7:
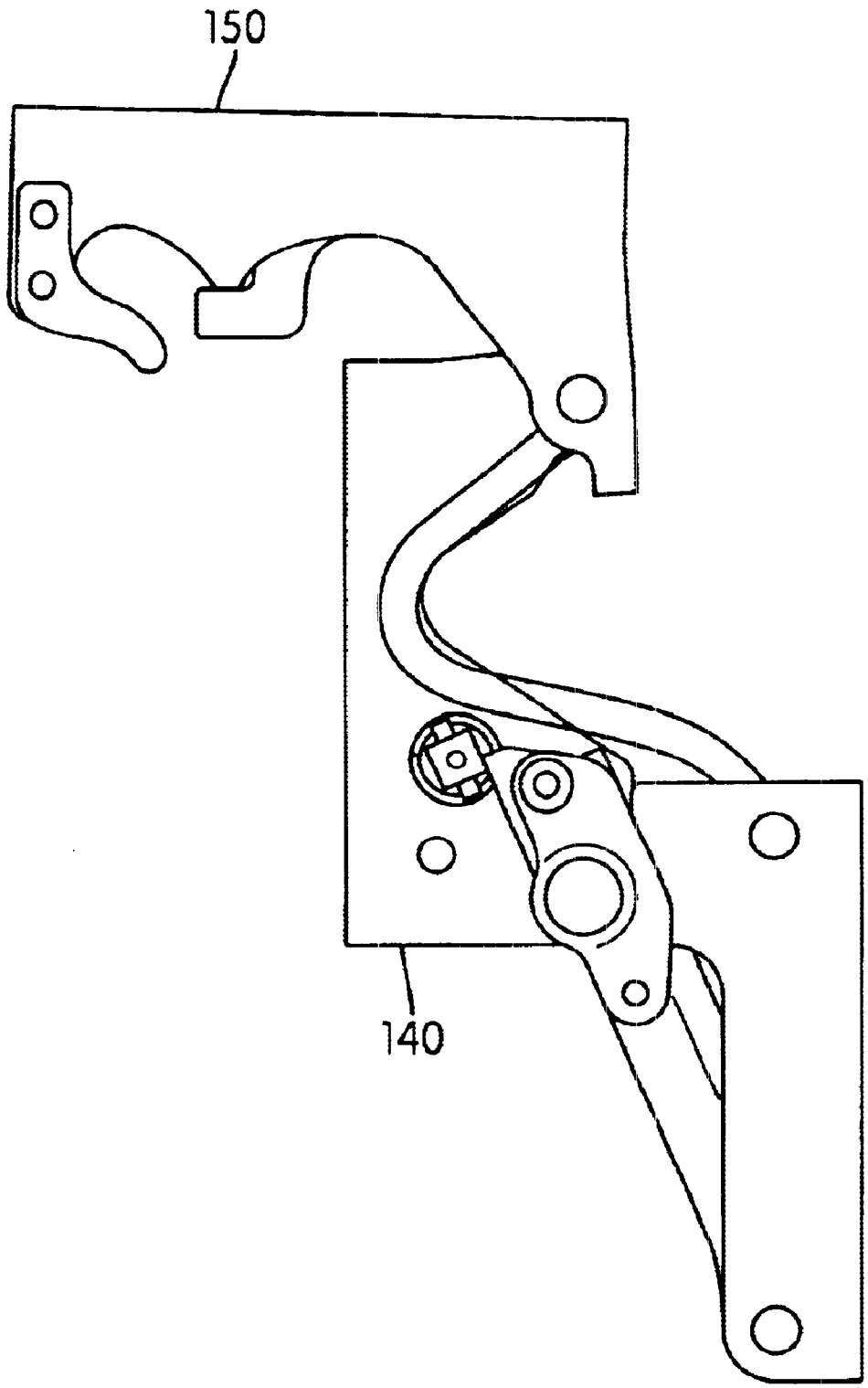
FIG. 7 is a top view of the hinge assembly of the invention showing the hinge assembly in the fully open position and showing the first lock mechanism in an unlocked position.

FIG. 7 shows the door bracket 150 after having pivoted about the door bracket carrier 140. The door bracket 150 pivots about the door bracket carrier 140 from the intermediate open position (FIG. 6) to the fully open position (FIG. 7).

Figure 8:
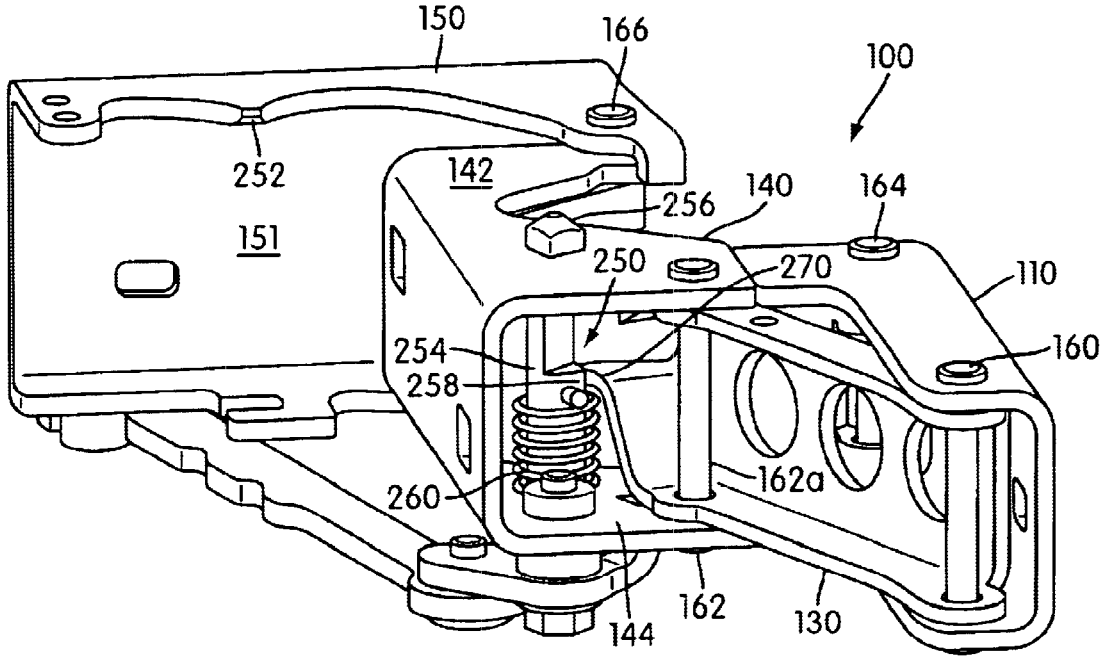
FIG. 8 is a perspective view showing the hinge assembly in the fully open position and showing a second lock mechanism in the locked position.
Figure 9:
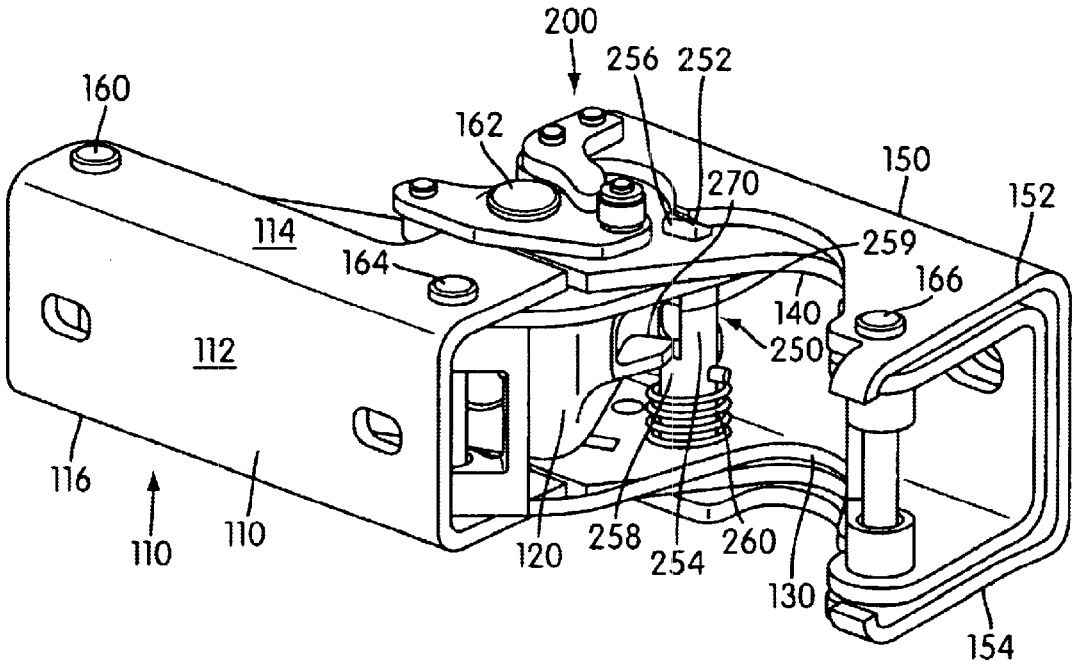
FIG. 9 is a perspective view showing the hinge assembly in the intermediate open position and showing the second lock mechanism in an unlocked position.

FIGS. 8 and 9 show a second lock mechanism 250 that locks the door bracket carrier 140 to the body bracket 110. As was previously mentioned, the second lock mechanism is part of the motion restriction mechanism of the hinge assembly. The second lock mechanism 250 restricts the door bracket carrier 140 from pivoting relative to the body bracket 110 as the door 12 moves between the intermediate and fully open positions. FIG. 8 shows the door bracket 150 in the fully open position. Specifically, the door bracket 150 has pivoted about the door bracket carrier 140 to the fully open position. In this position, the second lock mechanism 250 is locked and secures the door bracket carrier 140 from moving relative to the body bracket 110.

FIG. 9 shows the hinge assembly 100 as it is when the door 12 is in the intermediate open position. Specifically, the door bracket 150 has pivoted back about the door bracket carrier 140 to the intermediate open position. In this position, the second lock mechanism is unlocked and the door bracket carrier 140 is therefore free to move relative to the body bracket 110.

Referring to both FIGS. 8 and 9, The second lock mechanism 250 comprises first and second contact surfaces which move in relation to each other. The second lock mechanism 250 also comprises a third and fourth contact surfaces which also move in relation to each other. The second and third contact surfaces also move in unison.

The first contact surface is provided by a tab 252 that is disposed on the door bracket 150. The second contact surface is provided by the head 256 of a pin 254. The third contact surface is provided by a pin shaft 258 that is also disposed on the pin 254, and thus moves in unison with the pin head 256. The fourth contact surface is provided by a tab 270 disposed on the first link arm 120 and extending from the first link arm.

The door bracket tab 252 is adapted for contact with the pin head 256. The first link arm tab 270 of the first link arm 120 is adapted for contact with the pin shaft 258. The entirety of the pin 254 including the pin head 256 and the pin shaft 258 may move independently of the door bracket carrier 140. Again, however, as the pin head 256 and the pin shaft 258 are both disposed on the pin 254, they move in unison.

The door bracket tab 252 moves relative to the pin head 256 during pivoting movement of the door bracket 150. When the door 12 is in the intermediate open position, as is shown in FIG. 9, the door bracket tab 252 (i.e., the first contact surface) contacts the pin head 256 (i.e., the second contact surface); and, when the door 12 is in the fully open position, as is shown in FIG. 8, the door bracket tab 252 is disengaged from the pin head 256.

FIG. 8 shows the first link arm tab 270 extending from the link arm 120 in a direction substantially away from the body bracket. The first link arm tab 270 is shown contacting the surface of the pin shaft 258 when the door bracket 150 is in the fully open position and the door bracket tab 252 is disengaged from the pin head 256. This contact of the first link arm tab 270 (i.e., the fourth contact surface) on the pin shaft 258 (i.e., the third contact surface) restricts movement of the first link arm tab 270 relative to the pin shaft such that movement of the first link arm 120 relative to the door bracket carrier 140 is prohibited. This contact is maintained so long as the door 12 is swung beyond the intermediate open position, thus keeping door bracket carrier 140 fixed relative to the body bracket 110.

FIG. 9 shows how the first link arm tab 270 is freed from restriction by the pin shaft 258 when the door bracket tab 252 contacts the pin head 256. Specifically, the pin shaft includes a reduced section 259 proximate to the pin shaft contact surface 258 within which the first link arm tab 270 may move.

The pin 254 moves in a direction perpendicular to the plane of the movement of the door bracket carrier 140. In FIG. 9, upon the door 12 being moved from the fully open position to the intermediate position, the door bracket tab 252 overlaps and engages the pin head 256 causing the pin head 256 and the remainder of the pin 254 to move downward. This movement of the pin results in the pin shaft 258 moving downward relative to the first link arm tab 270. The first link arm tab 270 may now move relative to the pin shaft by moving within the reduced pin shaft section 259. Accordingly, the door bracket carrier 140 and the door bracket 150 may move in unison relative the body bracket 110 in the above described shifting manner.

As can be seen in FIG. 9, in the intermediate open position, neither the first lock mechanism 200, nor the second lock mechanism 250 are locked. Accordingly, in this position, either the door bracket 150 can be pivoted about the door bracket carrier 140, or the door bracket carrier 140 can move about the body bracket 110. However, if the door bracket 150 is pivoted about the door bracket carrier 140, the second lock mechanism 250 locks the door bracket carrier 140 relative to the body bracket 110, thus preventing shifting movement of the door bracket carrier 140 relative to the body bracket 110. Similarly, if the door bracket carrier 140 is moved about the body bracket 110, the first lock mechanism 200 locks the door bracket 150 relative to the door bracket carrier 140, thus preventing the swinging movement of the door bracket 150 relative to the other components of the hinge assembly 100.

FIGS. 8 and 9 also shows a coil spring 260. The spring 260 contacts and biases the pin 254 such that the spring moves the pin shaft contact surface 258 upwardly into contact with the link arm tab 270 when the door bracket tab 252 is not in contact with the pin head 256. In the second lock mechanism's unlocked position shown in FIG. 9, the pin 254 is moved downwardly against the spring force applied by the coil spring 260. In addition to the spring 260 biasing the pin 254 upwardly, the second back mechanism 250 includes fifth and sixth contact surfaces for pushing the pin 254 upwardly. The fifth contact surface is provided by the hook shaped tab 253 (FIG. 8) on the door bracket 150 and opposite tab 252. The sixth contact surface is provided by the lower head (not shown) of the pin 254, which has a configuration similar to head 256. When the door 12 is in the intermediate open position, the space 253' defined between the door bracket 150 and the hook 253 is aligned with the bottom end of the pin 254. This allows the pin 254 to be moved downwardly by engagement of the tab 252. However, as the door 12 is swung towards its fully open position, the tab 253 will engage the lower head of the pin 254 and force it upwardly. This assists the spring 260 to ensure the upward movement of the pin 254 is achieved. After the hook 253 passes the lower head of the pin 254, the spring 260 will maintain the pin 254 in that position.

FIGS. 8 and 9 also show the body bracket 110, the door bracket 150 and the door bracket carrier 140 each having a channel shape comprising a web and two opposing flanges. The web 112 of the body bracket is adapted for attachment to a vehicle body. The web 151 of the door bracket is adapted for attachment to a vehicle door.

FIG. 9 also shows how door bracket carrier 140 is substantially disposed within the opposing flanges 152 and 154 of the door bracket 150 when the hinge assembly is in the intermediate open position. This situation also occurs when the hinge assembly is in the fully closed position.

Figure 10:
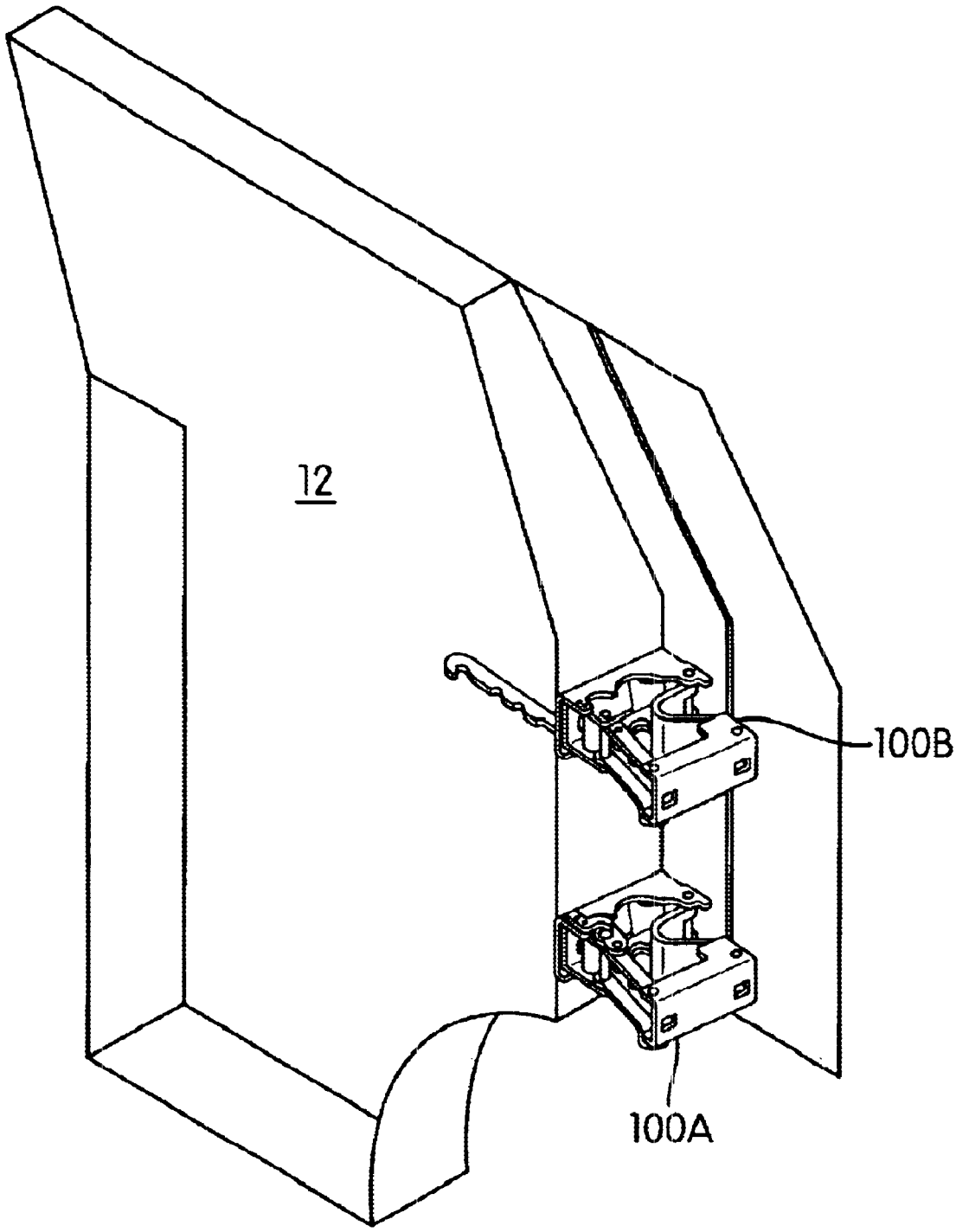
FIG. 10 is a perspective view showing two hinge assemblies disposed on a door in a typical configuration.

FIG. 10 shows how two hinges 100A and 100B may be disposed on a vehicle door 12 in a typical configuration.

FIG. 11 is a top view showing one specific use of the hinge assembly 100 of the present invention, and illustrates the benefits of the present invention. As shown, the hinge assembly 100 connects the door 12 to the body 10, a second door 14 is attached to the body A-pillar 11 by a conventional single pivot hinge assembly 15. The second door 14 is shown moving in a continuous arc 30. The door 12 attached to the hinge assembly 100 of the present invention moves first in shifting motion as the door bracket carrier moves in relation to the body bracket. The shifting motion is specifically curvilinear translation and is shown at the arc 20. This shifting motion moves the door 12 outwardly away from the vehicle body and also away from the adjacent door 14. Location 21 is the end of the arc 20 and denotes the intermediate open position for the hinge assembly 100 and the door 12 attached to the hinge assembly 100. Subsequent to achieving the intermediate open position, the door 12 may be opened to the fully open position by the swinging of the door bracket about the door bracket carrier. This swinging motion is a pivoting motion. The pivoting of the door bracket along with the door 12 about the door bracket carrier is shown at arc 22. As the door 12 has been first moved in shifting motion, as is shown in arc 20, the door 12 can now swing freely from the intermediate open position to the fully open position without contacting the door 14.

As was previously described, the first lock mechanism prevents the door bracket 150 from pivoting about the door bracket carrier until the door bracket carrier 140 has shifted relative to the body bracket 110. In other words, the door 12 cannot be moved in arc 22 until the door has first been moved in the arc 20 to the intermediate open position 21. Similarly, the second lock mechanism prevents the door bracket carrier from pivoting about the body bracket until the door 12 has been moved back to the intermediate open position shown at location 21. In other words, when closing the door 12, the door cannot move in the arc 20 until the door has moved in the arc 22 completely to the intermediate open position 21.

Finally, the benefits of the present invention are shown when comparing the movement of the door in arcs 20 and 22 to the movement of a single pivot door as is shown in arc 23. The arc of the single pivot door 23 obviously overlaps the door 14 when the door 14 is closed. For this reason, the door 12 would have to await the opening of the door 14 before the door 12 could be opened. The arcs 20 and 22, of the door 12 pivoting on the hinge assembly 100 of the present invention, allows the door 12 to open independently of the door 14. This situation is shown by the arcs 20 and 22 not overlapping the door 14 when the door 14 is closed.

While an advantageous version of the invention has been chosen to illustrate the invention, those skilled in the art will understand that various changes and modifications can be made therein without departing from the scope of the invention.

What is claimed:

1. A vehicle door hinge assembly for attaching a vehicle door in covering relation to a door opening provided in a vehicle body, said hinge assembly comprising:

a body bracket configured to be attached to the vehicle body;

a door bracket configured to be attached to the vehicle door; and, a door bracket carrier having said door bracket pivotally mounted thereon; the door bracket carrier being movably mounted to the body bracket such that, when said door bracket is attached to the vehicle door and said body bracket is attached to the vehicle body, said door bracket and the vehicle door to which said door bracket is attached move relative to the vehicle body and said body bracket between a fully closed position and a fully opened position through a multiple phase movement that comprises (a) a shifting phase wherein said door bracket carrier, said door bracket, and the door to which said door bracket is attached move in a shifting manner outwardly from the vehicle body from the fully closed position and an intermediate open position, and (b) a swinging phase wherein said door bracket and the door to which said door bracket is attached move in a swinging manner relative to the door bracket carrier and vehicle body between the intermediate position and the fully open position;

said hinge assembly having motion restriction structure that restricts movement of said door bracket relative to said body bracket such that (a) said door bracket is fixed with respect to said door bracket carrier during said shifting phase such that movement of said door bracket and the door to which said door bracket is attached during said shifting phase is restricted to the aforesaid shifting manner, and (b) said door bracket carrier is fixed with respect to said body bracket during said swinging phase such that movement of said door bracket and the door to which said door bracket is attached during said swinging phase is restricted to the aforesaid swinging manner, thereby preventing movement of the door in said shifting manner from occurring prior to or during movement of the door in said swinging manner.

2. The hinge assembly of claim 1, further comprising a first link arm interconnecting the door bracket carrier to the body bracket; wherein the door bracket carrier moves relative to the body bracket through the first link arm from the fully closed position to the intermediate open position.

3. The hinge assembly of claim 2, wherein the first link arm is pivotally connected to the door bracket carrier and the body bracket.

4. The hinge assembly of claim 2, further comprising a second link arm interconnecting the door bracket carrier to the body bracket; wherein the first link arm and the second link arm are both pivotally connected to the body bracket, and the first link arm and the second link arm are both pivotally connected to the door bracket carrier to provide a four-bar linkage constructed such that the shifting movement of the door bracket carrier in relation to the body bracket is curvilinear, with the door attached to the door bracket moving both outwardly relative to the vehicle body and substantially parallel to the door opening.

5. The hinge assembly of claim 4, wherein the hinge assembly further includes a pivot pin connecting the first link arm to the body; a second pivot pin connecting the second link arm to the body bracket; a third pivot pin connecting the door bracket carrier to the first link arm; and, a fourth pivot pin connecting the second link arm to the door bracket.

6. The hinge assembly of claim 5, wherein the fourth pivot pin connecting the second link arm to the door bracket carrier further connects the door bracket to the door bracket carrier.

7. The hinge assembly of claim 1, wherein the door bracket has a channel shape comprising a web and two opposing flanges; wherein the door bracket carrier is substantially disposed within the opposing flanges of the door bracket when the door bracket carrier moves between the filly closed and the intermediate open position.

8. The hinge assembly of claim 1, wherein the motion restriction mechanism comprises:

a first lock mechanism locking the door bracket to the door bracket carrier, such that the first lock mechanism locks the door bracket from moving relative to the door bracket carrier when the door bracket carrier moves between the fully closed and the intermediate open position; and, a second lock mechanism connecting the door bracket carrier to the body bracket; wherein the second lock mechanism locks the door bracket carrier from pivoting relative to the body bracket when the door bracket moves between the fully open and the intermediate open position.

9. The hinge assembly of claim 8, wherein the first lock mechanism comprises structure providing a first contact surface disposed on the door bracket; and structure providing a second contact surface disposed on the door bracket carrier; wherein movement of the door bracket carrier results in the relative movement of the second contact surface in relation to the first contact surface;

said first and second contact surfaces being positioned such that (a) said first and second contact surfaces are engaged with one another to prevent said door bracket from pivoting relative to said door bracket carrier when said door is in said fully closed position and as said door is moving between said fully closed and intermediate open positions thereof, and (b) said first and second contact surfaces are disengaged from one another upon the door reaching the intermediate position so as to allow the door bracket and the door attached thereto to pivot relative to said door bracket carrier.

10. The hinge assembly of claim 9, wherein said structure providing the first contact surface is an elongated curved element having a first end attached to the door bracket and a distal end extending outward from the door bracket.

11. The hinge assembly of claim 9, wherein the second contact surface is curved.

12. The hinge assembly of claim 10, wherein said structure providing the second contact surface is a roller that rollingly engages said contact surface as the door is moved between the fully closed position and the intermediate open position.

13. The hinge assembly of claim 12, further comprising a first link arm interconnecting the door bracket carrier to the body bracket; wherein the door bracket carrier moves about the body bracket through the first link arm from the fully closed position to the intermediate open position; and, wherein the roller is pivotally attached to the first link arm.

14. The hinge assembly of claim 8, further comprising a first link arm interconnecting the door bracket carrier to the body bracket; wherein the door bracket carrier moves about the body bracket through the first link arm from the fully closed position to the intermediate open position;

the second lock mechanism comprising: structure providing a first contact surface disposed on the door bracket; structure providing both a second contact surface and a third contact surface moveably mounted on the door bracket carrier; structure providing a fourth contact surface disposed on the first link arm; said first and second contact surfaces being positioned with respect to one another such that (a) as said door, said door bracket and said door bracket carrier are moved from said fully closed position to the intermediate position, said first contact surface engages said second contact surface to maintain the locking structure in a de-activated position, (b) as said door bracket is pivoted relative to said door bracket carrier during the swinging movement of the door bracket and the door, said first contact surface is disengaged from said second contact surface to enable the locking structure to move to an activated position, and (c) as said door bracket is pivoted relative to said door bracket carrier to move the door in a closing direction into the intermediate open position, the first contact surface is engaged with the second contact surface to move the lock structure to the activated position thereof;

said third and fourth contact surfaces being positioned with respect to one another such that (a) when said lock structure is in its activated position the third contact surface engages said fourth contact surface to block movement of said first link arm and thus fix the door bracket carrier relative to said body bracket and (b) when said lock structure is in its disengaged position the third contact surface is disengaged from the fourth contact surface to allow for movement of the first link arm and thus allow the door bracket carrier to move relative to said body bracket.

15. The hinge assembly of claim 14, wherein said lock structure moves in a direction perpendicular to the plane of the movement of the door bracket carrier.

16. The hinge assembly of claim 14, wherein said lock structure is a pin including a pin head providing said second contact surface and a pin shaft providing said third contact surface, the pin shaft including a reduced section proximate to the third contact surface, said reduced section being positioned and configured such that when said pin is in said de-activated position, said reduced section is moved adjacent the fourth contact surface to allow said link arm to move therethrough.

17. The hinge assembly of claim 16, wherein the fourth contact surface comprises a tab extending from the link arm in a direction substantially away from the body bracket.

18. The hinge assembly of claim 17, wherein said second lock mechanism further comprises a spring; wherein the spring biases the pin to the activated position.

* * * * *